US005704881A

United States Patent [19]

Dudley

[11] Patent Number: 5,704,881

[45] Date of Patent: Jan. 6, 1998

[54] APPARATUS FOR COUNTERBALANCING REHABILITATING PATIENTS

[75] Inventor: Robert H. Dudley, Kalamazoo, Mich.

[73] Assignee: LiftAire, Kalamazoo, Mich.

[21] Appl. No.: 546,689

[22] Filed: Oct. 23, 1995

[51] Int. Cl.[6] ..... A63B 23/04

[52] U.S. Cl. ..... 482/69; 601/23; 602/36; 482/43

[58] Field of Search ..... 482/23, 43, 67, 482/68, 69, 95, 143; 5/81.1 R, 81.1 T, 83.1, 84.1, 85.1; 602/32–36; 606/241; 601/23; 135/67, 71, 72; 297/275, DIG. 10

[56] References Cited

U.S. PATENT DOCUMENTS

| | | | |
|---|---|---|---|
| 2,478,004 | 8/1949 | Newell | 482/69 |
| 3,730,587 | 5/1973 | Bloxham et al. | 482/69 |
| 5,064,191 | 11/1991 | Johnson | 482/143 |
| 5,333,333 | 8/1994 | Mah | 5/81.1 |
| 5,372,561 | 12/1994 | Lynch | 482/74 |

FOREIGN PATENT DOCUMENTS

| | | | |
|---|---|---|---|
| 622473 | 9/1978 | U.S.S.R. | 482/43 |
| 1147390 | 3/1985 | U.S.S.R. | 606/241 |

OTHER PUBLICATIONS

Advertisement by Vigor Equipment Inc. date Jun. 1995.

Advertisement by Soma for Zuni II date Jun. 1995.

*Primary Examiner*—Jeanne M. Clark
*Attorney, Agent, or Firm*—Bliss McGlynn, P.C.

[57] ABSTRACT

A counterbalancing assembly reduces the weight of an exercising person by pulling the exercising person upwardly. The counterbalancing assembly includes a monolithic support structure which is secured to a base. A cantilever support extends out from the top of the monolithic support structure. A cable extends from the top of the monolithic support structure, down through a linear actuator, and back up through the monolithic support structure to the cantilever support. The cable extends down from the end of the cantilever support to a position suitable for an exercising person to comfortably exercise on a piece of exercising equipment. A spring at the fixed end of the cable provides an unloading force accommodating to the exercising patient movement and dampens sudden movements created by the exercising person. A linear actuator is used to adjust the length of the cable extending down from the cantilever support and to tension the spring.

13 Claims, 2 Drawing Sheets

46
42
44
34
48
10
50
40
54
56
26
12
30
14
36
32
16
38
20
22
34

APPARATUS FOR COUNTERBALANCING REHABILITATING PATIENTS

BACKGROUND OF THE INVENTION

1. Field of the Invention

The present invention relates to exercise equipment. More particularly, the invention relates to exercise equipment used to rehabilitate damaged or diseased body parts.

2. Description of Related Art

As restraints on money dedicated to health care grow, newer and less expensive ways of performing proven techniques of rehabilitation are constantly being sought. One such area earmarked as costly rehabilitation is that associated with the use of a pool to reduce the gravitational effect of the mass of the exercising person or patient when rehabilitating damaged or diseased body parts and/or appendages, e.g., lower back, hips, knees, and ankles. Typically, the pool is used to buoy or support a portion of the body weight of the exercising person to aid in the rehabilitation of joints, bones, muscles, tendons and the like. A pool, however, is a costly piece of equipment, both to purchase and to maintain. Additional problems associated with pool rehabilitation include an undesired drag effect when the exercising person tries to move in the water. This drag effect is not commensurate with movement on land. Also, there exists an inability to adjust the weight of the body buoyed by the water which eliminates all graduated exercising programs.

U.S. Pat. No. 4,907,571 issued to Futakami on Mar. 13, 1990, discloses an ambulatory apparatus which negates the need for a pool when rehabilitating the legs and other tissues related to walking. This system includes a main body wherefrom a supporting arm extends. The patient is suspended from a suspension member. A hand rail extends around the main body and is used by the patient as he or she attempts to walk. An air cylinder provides a support arm with an upperwardly directed force to support the weight of the patient.

This system, however, is deficient in a few aspects. First, the system utilizes sophisticated electronics and linkage sub-systems, the uses of which increase the cost of the assembly. Second, this ambulatory apparatus is not conducive to increasing magnitude at which the legs move. More specifically, the exercising person cannot increase his or her speed without favoring one side or the other, depending on the direction of movement around the base. This favoring of one side or the other may not be acceptable in some rehabilitation situations. Also, the exercising person running around the base is likely to get dizzy which will reduce the ability to efficiently increase the motor skills associated with learning how to walk again. Finally, and most importantly, this ambulatory apparatus discloses the use of an air cylinder.

U.S. Pat. No. 4,898,378 issued to Edwards et. al, on Feb. 6, 1990, discloses a safety harness for use with a treadmill wherein an on/off switch turns the treadmill located therebelow off when the user of the treadmill falls. This patent does not disclose any apparatus capable of applying a force opposing the gravitational force of the body of the treadmill user to allow the exercising person to rehabilitate his or her legs with graduated waiting.

U.S. Pat. No. 3,721,327 issued to Skaricic on Mar. 20, 1970 discloses an apparatus used to train a person to walk. This system is designed with a shock absorber which reduces the speed and, therefore, damage to the person using the walking trainer upon losing balance and falling, and does not counter the gravitational force acting on the person.

SUMMARY OF THE INVENTION

A counterbalance assembly reduces the weight of an exercising person. The counterbalance assembly comprises a base and monolithic support structure defining a housing extending upwardly substantially perpendicular to the ground. The monolithic support structure defines a base engaging end and a top end. The base engaging end is fixedly secured to the base. A cantilever support is fixedly secured to the top end and extends out from the monolithic support structure generally perpendicular thereto. A flexible force transmitting device having a fixed end, a load bearing end, and a length therebetween, extends through the housing and the cantilever support. The load bearing end extends down from the cantilever support to receive the exercising person. The counterbalance assembly further includes a linear adjuster secured to the flexible force transmitting device to adjust the load bearing end upwardly such that the exercising person experiences reduced weight by compressing a mechanical or pneumatic spring thereby applying an upwardly directed force on the exercising person.

The advantages associated with the invention include providing an inexpensive assembly for reducing or countering the gravitational force acting on a body to effectively reduce the weight of a person such that a person can rehabilitate damaged or diseased body parts by gradually increasing the amount of effective weight realized by the damaged or diseased body parts until full body weight and full range of effort have been applied thereto. The countergravity assembly is inexpensive because it does not require the use of a pool. Further, the control mechanism, scale, and support structure are not complicated eliminating the requirements for large part inventories and hours to manufacture. Additionally, the monolithic support structure, in combination with the base and the cantilever support, provide a compact counterbalance assembly which may be easily transportable to different areas depending on need. More specifically, the counterbalance assembly does not have be disassembled to be moved and may be easily moved to various exercise equipment or rooms of patients.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT(S)

Figure 1:
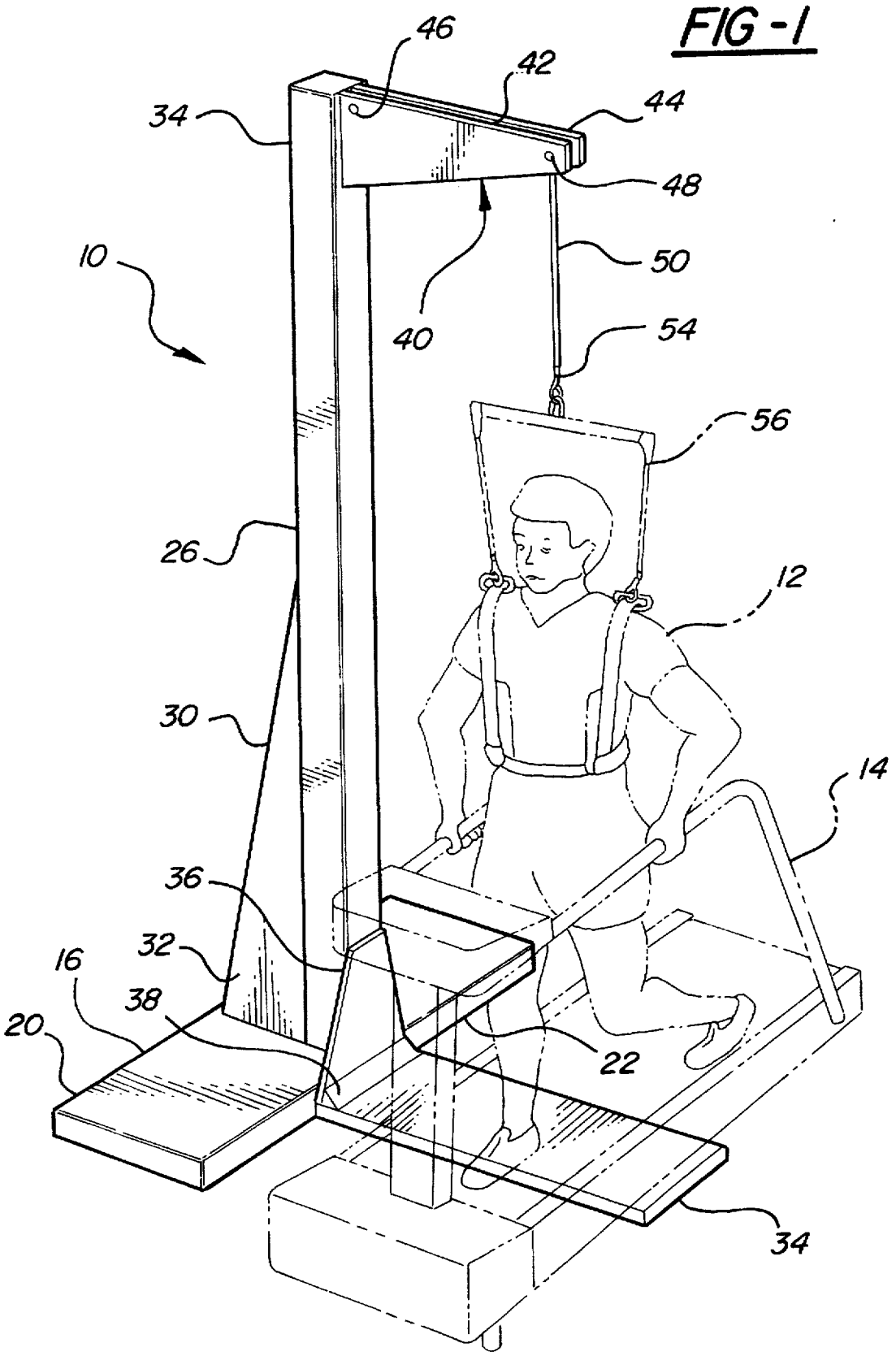
FIG. 1 is a perspective view of the preferred embodiment of the invention with an exercising person and a piece of exercise equipment shown in phantom.
Figure 2:
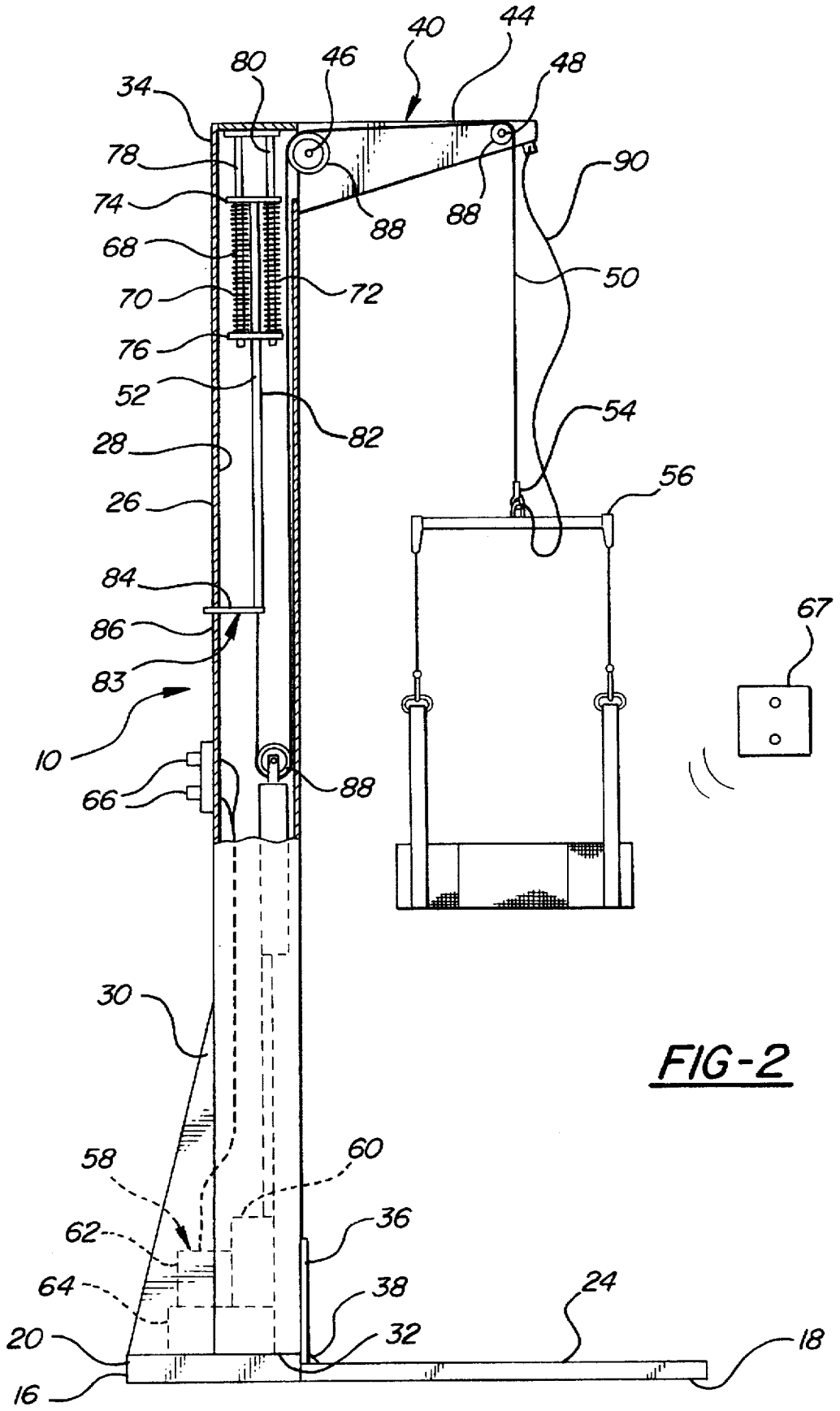
FIG. 2 is a side view of the preferred embodiment of the invention partially cut away.

Referring to the Figures, the counterbalance assembly generally indicated at 10. The counterbalance assembly 10 reduces the weight of an exercising person 12 using a piece of exercise equipment. In FIG. 1, the exercising equipment is a treadmill 14. It may be apparent to those skilled in the art that the exercising equipment may include pieces of equipment other than the treadmill 14. In particularly, stationary bicycles and stair machines may be used depending on the requirements of the rehabilitation of the exercising person 12.

The counterbalance assembly 10 includes a base 16 having a floor surface 18. In one embodiment, rubber grommets (not shown) may be secured to the floor surface 18 to reduce damage to the floor. The floor surface 18 engages the ground or floor and is, therefore, substantially planar. The base 16 includes first 20, second 22, and third 24 legs. In one embodiment, the base 16 is one piece including the three legs 20, 22, 24. All of the legs 20, 22, 24, extend out from a monolithic support structure 26.

The monolithic support structure 26 defines a housing 28 and extends upwardly substantially perpendicular to the ground and, more particularly, the base 16. In the preferred embodiment, the monolithic support structure 26 is tubular having a rectangle or square cross-section. The monolithic support structure 26 also includes a secondary support structure 30 which houses the controls, discussed subsequently. The monolithic support structure 26 includes a base engaging end 32 and a top end 34. The base engaging end 32 is fixedly secured to the base 16. A brace 36 and spacer 38 maintain the monolithic support structure 26 perpendicular to the third leg 24 of the base 16.

A cantilever support 40 is fixedly secured to the top end 34 and extends out from the monolithic support structure 26 generally perpendicular thereto. The cantilever support 40 is smaller in length than the monolithic structure 26 such that the exercising person 12 utilizes the counterbalance assembly 10 in a position substantially close to the monolithic support structure 26. This allows the counterbalance assembly 10 to have a center of gravity relatively close to the monolithic support structure 26 when in use. In one embodiment, the cantilever support 40 is fabricated from two side panels 42, 44 which are secured together using two bolts 46,48. The cantilever support 40 extends out from the monolithic support structure 26 in the same direction as the third leg 24. More specifically, the third leg extends out from the monolithic support structure 26 below the cantilever support 40 to reduce or minimize the tendency of the counterbalance assembly 10 from tipping due to the weight of the exercising person 12.

A flexible force transmitting device 50 includes a fixed end 52, a load bearing end 54, and a defined length therebetween. The flexible force transmitting device 50 extends through the housing 28 and the cantilever support 40. The load bearing end 54 extends down from the cantilever support 40 to receive the exercising person 12. In the preferred embodiment, the flexible force transmitting device 50 is a cable.

A harness 56 is removably secured to the load bearing end 54 of the cable 50 and is used as a means to secure the exercising person 12 to the cable 50. The harness 56 may designed in any number of ways which provide support in a fashion to allow the exercising person 12 to exercise in an upright, balanced position.

The counterbalance assembly 10 also includes a linear adjuster, generally shown at 58, which is secured to the flexible force transmitting device 50 to move the load bearing end 54 upwardly. When the load bearing end 54, and the harness 56, are moved upwardly toward the cantilever support 40, the exercising person 12 experiences reduced weight because the pulling on the exercising person 12 counters the gravitational forces exerted on the exercising person 12. The linear adjuster 58 is secured to the cable 50 along the length thereof between the fixed end 52 and the load bearing end 54. The linear adjuster 58 is a linear actuator 60 which is operated by a motor 62. The linear actuator 60 and the motor 62 are secured to the base 16 by a platform 64. A control 66 is secured to the monolithic support structure 26. The control 66 is electrically connected to the linear actuator 60 and/or the motor 62 to remotely control the linear actuator 60. Although the control 66 is mounted to the outside of the monolithic support structure 26, it would be apparent to those skilled in the art that the control 66 may be mounted anywhere along the monolithic support 26 or the secondary support structure 30. Also, the control 66 may be a remote unit 67 wherein a transmitter and receiver would couple the controls to the motor 62.

A resilient member such as a spring 68 in one embodiment provides a resilient force which is received by the flexible force transmitting device 50 from the exercising person 12. More specifically, the spring 68 provides for movement created by the exercising person 12, while maintaining the preset weight reduction. In one embodiment, the spring 68 is a tension spring assembly having two springs 70, 72 in tension between two plates 74, 76, with the top plate 74 sliding along two guiding rods 78, 80. The flexible force transmitting device 50 is secured to the top plate 74 so that any force exerted on the flexible force transmitting device 50 will place the two springs 70, 72 in tension. Although the spring 68 is shown as a spring secured to the fixed end 52 of the flexible force transmitting device 50, it will be apparent to those skilled in the art that the spring 68 may in fact comprise a plurality of springs located at various positions along the flexible force transmitting device 50. Also, a dampener may be attached to the forced generator 58 to help reduce impulses. Further, it may be apparent to those skilled that an air spring may replace the mechanical spring 68.

Depending from the top plate 74 through the bottom plate 76 is a connecting rod 82. The connecting rod 82 connects the top plate 74 to a weight reduction scale 83 which includes an indicator 84. The indicator 84 extends down a desired distance to be easily viewed and out of the monolithic support structure 26. A scale 86 indicates the amount of weight which is effectively removed from the exercising person 12. The scale 86 is linear because the two springs 70, 72 are in tension which creates a displacement in direct proportion to the tension force. More specifically, the displacement of the indicator 84 is linear with the amount of tension force exerted on the two springs 70, 72.

A plurality of directional members 88 alter the direction of the forces acting on the cable 50. The plurality of directional members are pulleys 88 in the preferred embodiment. These pulleys 88 help move the cable 50 along the cantilever support 40 and the monolithic support structure 26. The pulleys 88 which are located in the cantilever support 40 are rotated about the two bolts 46, 48.

A second flexible member 90, having a length greater than the portion of the flexible force transmitting device 50 extending between the cantilever support 40 and the harness 56. The second flexible member 90 provides a safety line in the event the flexible force transmitting device 50 should break.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

I claim:

1. A counterbalance assembly for reducing the weight of an exercising person, said counterbalancing assembly comprising:

a base;

a monolithic support structure extending upwardly substantially perpendicular to ground, said monolithic support structure defining a base engaging end and a top end, said base engaging end secured to said base;

a cantilever support fixedly secured to said top end extending out from said monolithic support structure generally perpendicularly thereto;

a flexible force transmitting device having a fixed end, a load bearing end, and a length therebetween, said flexible force transmitting device extending through said monolithic support structure and said cantilever support, said load bearing end extending down from said cantilever support;

a harness secured to said load bearing end to receive the exercising person disposed outside and adjacent to said monolithic support structure;

a linear adjuster secured to said flexible force transmitting device to move said load bearing end upwardly; and a resilient member operatively connected to said flexible force transmitting device in a manner in which said resilient member is compressed when the exercising person exerts a downward force on said load bearing end thereby dampening pulses of force received by the exercising person in a linear fashion, said resilient member including a spring fixedly secured to said top end of said monolithic support structure.

2. A counterbalance assembly as set forth in claim 1 wherein said linear adjuster is secured to said flexible force transmitting device along said length thereof.

3. A counterbalance assembly as set forth in claim 2 including a plurality of directional members disposed adjacent said flexible force transmitting device to alter the direction of the force received by the exercising person.

4. A counterbalance assembly as set forth in claim 3 wherein said linear adjuster is a linear actuator.

5. A counterbalance assembly as set forth in claim 4 wherein said flexible force transmitting device is a cable.

6. A counterbalance assembly as set forth in claim 5 wherein said plurality of direction members is a plurality of pulleys.

7. A counterbalance assembly as set forth in claim 6 wherein said base includes first, second, and third legs.

8. A counterbalance assembly as set forth in claim 7 wherein said third leg extends out from said monolithic support structure below said cantilever support.

9. A counterbalance assembly as set forth in claim 8 wherein said monolithic support structure includes a plurality of controls electrically connected to said linear actuator to remotely control said linear actuator.

10. A counterbalance assembly for reducing the weight of an exercising person, said counterbalancing assembly comprising:

a base;

a monolithic support structure defining a housing and extending upwardly substantially perpendicular to ground, said monolithic support structure defining a base engaging end and a top end, said base engaging end fixedly secured to said base;

a cantilever support fixedly secured to said top end extending out from said monolithic support structure generally perpendicular thereto;

a flexible force transmitting device having a fixed end, a load bearing end, and a length therebetween, said flexible force transmitting device extending through said housing and said cantilever support, said load bearing end extending down from said cantilever support;

a harness secured to said load bearing end to receive the exercising person;

a linear adjuster secured to said flexible force transmitting device to adjust said load bearing end upwardly such that the exercising person experiences reduced weight by pulling the exercising person up countering gravity; and a tension spring assembly secured to said monolithic support structure and said fixed end of said flexible force transmitting device in a manner in which said tension spring assembly is linearly compressed when the exercising person exerts a downward force on said load bearing end thereby dampening pulses of force received by the exercising person.

11. A counterbalance assembly as set forth in claim 10 including a weight reduction scale to measure said force provided by said tension spring assembly.

12. A counterbalance assembly as set forth in claim 11 wherein said weight reduction scale is fixedly secured to said tension spring assembly.

13. A counterbalance assembly as set forth in claim 12 including a remote control device for remotely controlling said linear adjuster.

* * * * *